United States Patent [19]

Geib et al.

[11] Patent Number: 4,995,829

[45] Date of Patent: Feb. 26, 1991

[54] WIRE TERMINATION CONNECTOR AND TERMINAL BLOCK

[75] Inventors: Lawrence E. Geib, Carol Stream; William R. Bailey, Glen Ellyn; James S. Zielinski, Roselle, all of Ill.

[73] Assignee: Reed Devices, Inc., Carol Stream, Ill.

[21] Appl. No.: 457,572

[22] Filed: Dec. 27, 1989

[51] Int. Cl.[5] ..... H01R 4/24

[52] U.S. Cl. ..... 439/409

[58] Field of Search ..... 439/389–425

[56] References Cited

U.S. PATENT DOCUMENTS 3,605,073 9/1971 Vetter ..... 439/409

4,341,430 7/1982 Crawford ..... 439/409

FOREIGN PATENT DOCUMENTS 271413 6/1988 European Pat. Off. ..... 439/409

*Primary Examiner*—Joseph H. McGlynn

*Attorney, Agent, or Firm*—Weingarten, Schurgin, Gagnebin & Hayes

[57] ABSTRACT

A connector provides wire termination, without the need for any tools, facilitating electrical connection and trimming of excess wire by way of pressure applied by a human finger. Connection is accomplished by means of a rotational mechanism comprising an insulative base housing, a conductive electrical terminal and a non-conductive cam lever. The cam lever is configured around a rotating hub and has a wire passageway therethrough. the conductive electrical terminal, has a first insulation displacement contact and a second feedthrough/trimming contact, and fits slidably in the insulative base housing. With a wire installed through the wire passageway and feedthrough/timming contact, manual rotation of the cam lever and exertion of finger pressure terminates the wire in the conductive terminal and trims excess wire. A detent retains the cam lever in the engaged position. Reverse rotational movement of the cam lever frees the wire for removal.

31 Claims, 7 Drawing Sheets

WIRE TERMINATION CONNECTOR AND TERMINAL BLOCK

FIELD OF THE INVENTION

This invention relates to insulation displacement connectors for electrical termination in field wiring applications.

BACKGROUND OF THE INVENTION

The proliferation of voice and data transmission technology has borne a concomitant proliferation in the hardware necessary to support that technology. Integral to the networks of phones, data terminals and processors facilitating transmission are multitudes of connectors, or terminal blocks, which connect the wires to effect the actual passage of electrical voice and data signals. Ease and reliability in configuring wiring networks must be a major consideration in the design of terminal blocks to be used in these vast networks.

Early connector and terminal block panels used screw-type binding post terminals which, while offering flexibility, required the manual cutting to length, stripping, wrapping, and fastening of the wire to the terminal block by means of a screwdriver. In addition to the cumbersome nature of the wiring procedure these connections could not be gas tight and were prone to becoming unreliable over time.

More recently, insulation displacement contacts (I.D.C.) have eliminated the need for stripping wires. I.D.C. connectors generally have Y-shaped resilient contacts which, when a wire is forced into the contacts, displace the insulation surrounding the conductive core of the wire providing electrical continuity. U.S. Pat. No. 4,262,984, to Takahashi, illustrates the insulation displacement concept. Some insulation displacement connectors have also eliminated the need for cutting a wire to length as wire trimming is facilitated upon installation into the I.D.C. connector. However, many I.D.C. connectors still require the use of a tool in making the electrical connection between wire and connector.

Today's business and social communities continue to bring increasing communications networking opportunities. Installation space accommodations, therefore, are demanding increasingly higher priority. This, obviously, translates into a need for equipment and/or components which offer a higher density of terminals within a relatively limited, or confined space.

SUMMARY OF THE INVENTION

The present invention provides a low-cost, high density, easily manufactured connector which can be configured in terminal blocks and which makes a gas tight insulation displacement connection requiring neither the trimming of excess wire nor the use of tools in making the connection.

According to the invention, an electrical connector for terminating an electrical conductor comprises three subparts, a conductive base housing, an electrically conductive terminal and a non-conductive cam lever. In cooperation, these subparts facilitate the trimming and reliable insulation displacement connection of an electrical conductor, by the application of only pressure from a human finger.

Features of the invention include stress relieving slots for flexibility in the base housing providing low stress assembly of the subparts. The base housing may be configured with male and/or female dovetail extensions for "ganging" a plurality of housings together. Detent means are provided for engaging the non-conductive cam lever to the base housing with a tactile response and for retaining the subparts so engaged. A test point portion is provided on the electrically conductive terminal which is accessible through the insulative base housing permitting ease of test probing when the subparts are engaged with an electrical wire installed. Also, a protruding lower member of the electrically conductive terminal may be an I.D.C. for connecting the connector in a terminal block configuration or it may be pin-like for connecting to a feed-through on a printed circuit board. Furthermore, a wire passageway and wire guide in the non-conductive cam lever may be specifically sized to accept certain wire sizes while rejecting oversized wires.

BRIEF DESCRIPTION OF THE DRAWINGS

The invention will be more fully understood from the following detailed description of illustrative embodiments taken in conjunction with the accompanying drawings in which.

DETAILED DESCRIPTION OF THE INVENTION

Figure 1:
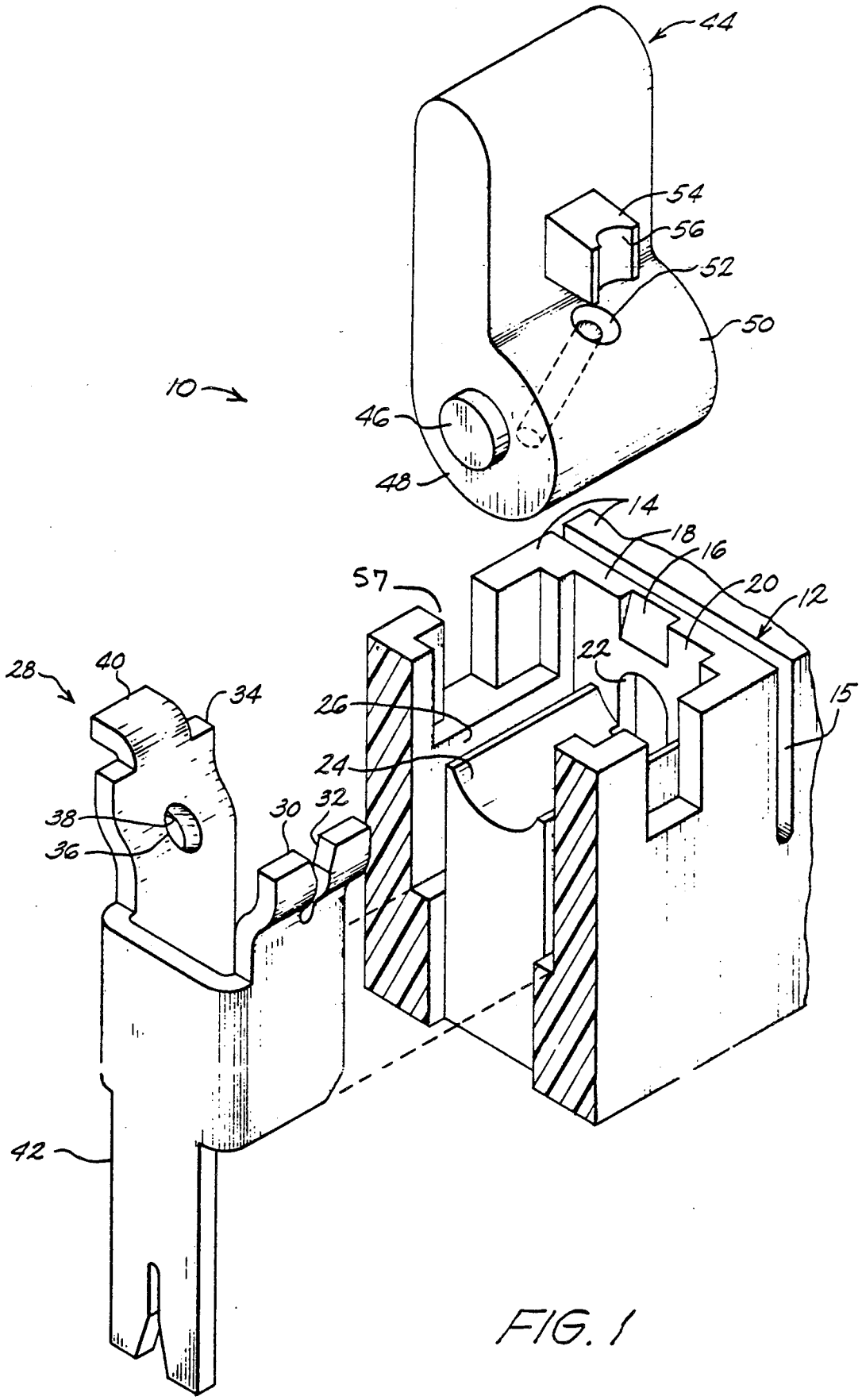
FIG. 1 is an exploded view, partially in section, of an electrical connector for terminating an electrical conductor according to the invention.

An electrical connector for terminating an electrical conductor according to the invention comprises three subparts and requires no tools in its function. Referring now to FIGS. 1, and 2A through 2D, the electrical connector 10 comprises an insulative base housing 12. The base housing 12, molded from insulative polymeric material as known in the art, has a plurality of walls 14, opposed in pairs. The walls 14 are interposed with stress relieving means 15, generally slots, to permit some flexing of the walls during assembly of the connector. Each of a pair of opposed walls has an angular notch 16 extending from an upper end surface 18 to an inner surface 20. A groove 22, substantially the same width as the angular notch 16 is disposed on the inner surface 20 of the same pair of walls. Outer surfaces of walls 14 of base housing 12 may be molded having either a dovetail tenon 21, as illustrated in FIG. 2C, or a similarly shaped dovetail mortise 23. The dovetail mortise 21 and tenon 23 facilitate coupling or "ganging" of a plurality of insulative base housings 12, as illustrated in FIG. 2D. An arcuate surfaced support section 24, is intermediate to and bounded by the plurality of walls 14. The arcuate surfaced support section 24 is recessed relative to the walls 14 and is separated from three walls by void 26, forming a terminal receiving cavity. Void 26, accommodates an electrically conductive terminal 28.

The electrically conductive terminal 28 is contoured to fit slidably into void 26 of insulative base housing 12. A first contact means 30 has an insulation displacement connection means 32 and is opposite a second contact means 34. Second contact means 34 has a feed-through void 36 substantially aligned with the insulation displacement connection means 32 of first contact means 30. The feed-through void 36 of second contact means 34 has a trimming edge 38. A test point portion 40 on second contact means 34 is angled outward, away from the first contact means 30. First contact means 30 and second contact means 34 are joined at a lower extending member 42 which may also be an insulation displacement connection as in FIG. 1, or it may be a pin-like member 42 for inserting into a printed circuit board feed-through as in FIGS. 2A and 2B.

A non-conductive cam lever 44 has a lateral hub 46 protruding from a first end 48 and protruding from a second end 50. The cam lever 44 has a wire passageway 52, at its approximate center of rotation, extending through it substantially perpendicular to an axis from the first end 48 to the second end 50 through the center of lateral hub 46. In alignment with the wire passageway 52 is a wire guide 54 having an arcuate surface 56 which may be specifically sized to accommodate certain wire sizes.

A fully assembled wire termination connector 10 requires that the electrically conductive terminal 28 be slidably installed into the insulative base housing 12. The electrically conductive terminal 28 is contoured such that gap 57 in the insulative base housing 12 will accommodate the test point portion 40 of the electrically conductive terminal 28 and the test point portion 40 will be accessible through the insulative base housing. With the electrically conductive terminal 28 slidably installed in the terminal receiving cavity of insulative base housing 12, the non-conductive cam lever 44 is mated with the insulative housing by aligning the lateral hub 46 at the first end 48 and second end 50 with the angular notch 16 in each of a pair of the plurality of walls in the insulative base housing 12. Applying a force transverse to the lateral hub 46 of the cam lever 44 pushes the cam lever 44 down the ramp provided by angular notches 16. Sufficient force flexes the insulative base housing at stress relieving slots 15 and enables the cam lever to be driven down the ramp until lateral hub 46, at first end 48 and second end 50, seats, mating with groove 22 on each of the pair of the plurality of walls. Non-conductive cam lever 44 resides cradled in the combination of conductive electrical terminal 28 and insulative base housing 12, effectively resting on the arcuate surfaced support section 24 and a curved saddle provided by first contact means 30 and second contact means 34 of electrically conductive terminal 28.

Referring now to FIGS. 2C and 2D, a plurality of housings may be joined together by ganging several connectors via dovetail mortise 23 and tenon 21 which may be incorporated into an outer surface of the walls 14 of the molded insulative base housing 12. Any number of housings may be ganged, as illustrated in FIG. 2D.

Figure 2B:
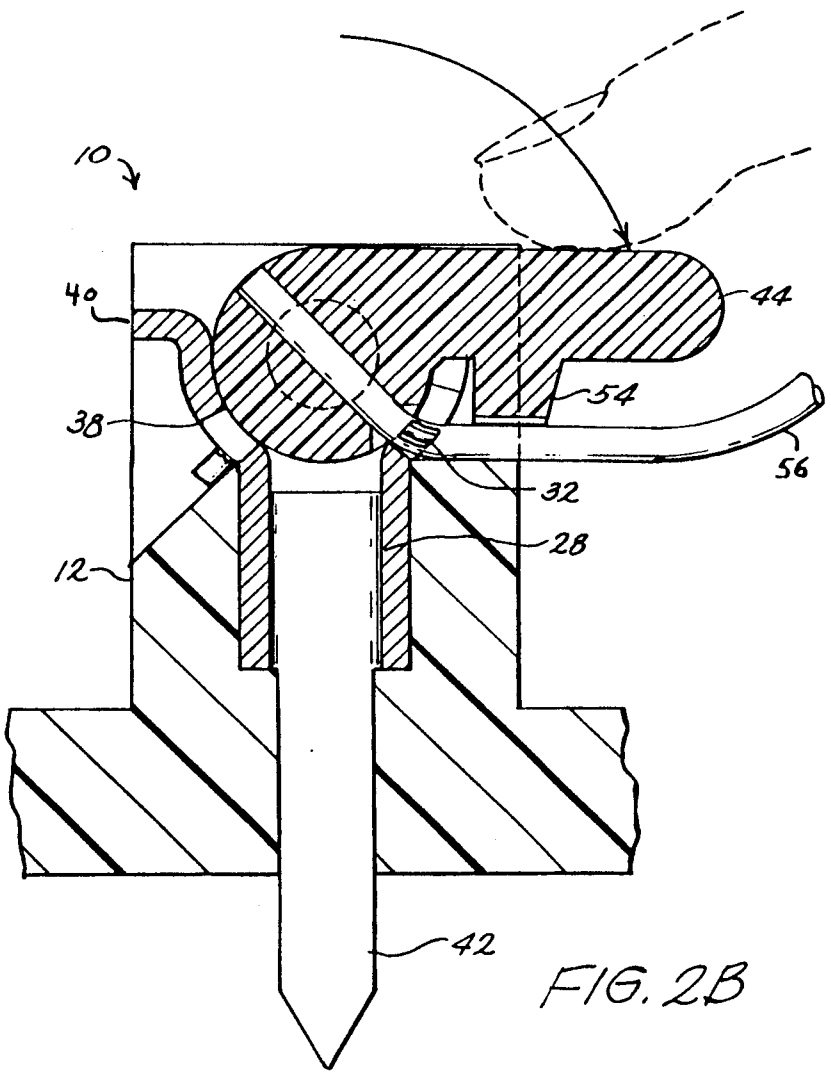
FIG. 2B is a side view partially in section of the electrical connector of FIG. 1 in a second position with the electrical conductor trimmed and connected.
Figure 2A:
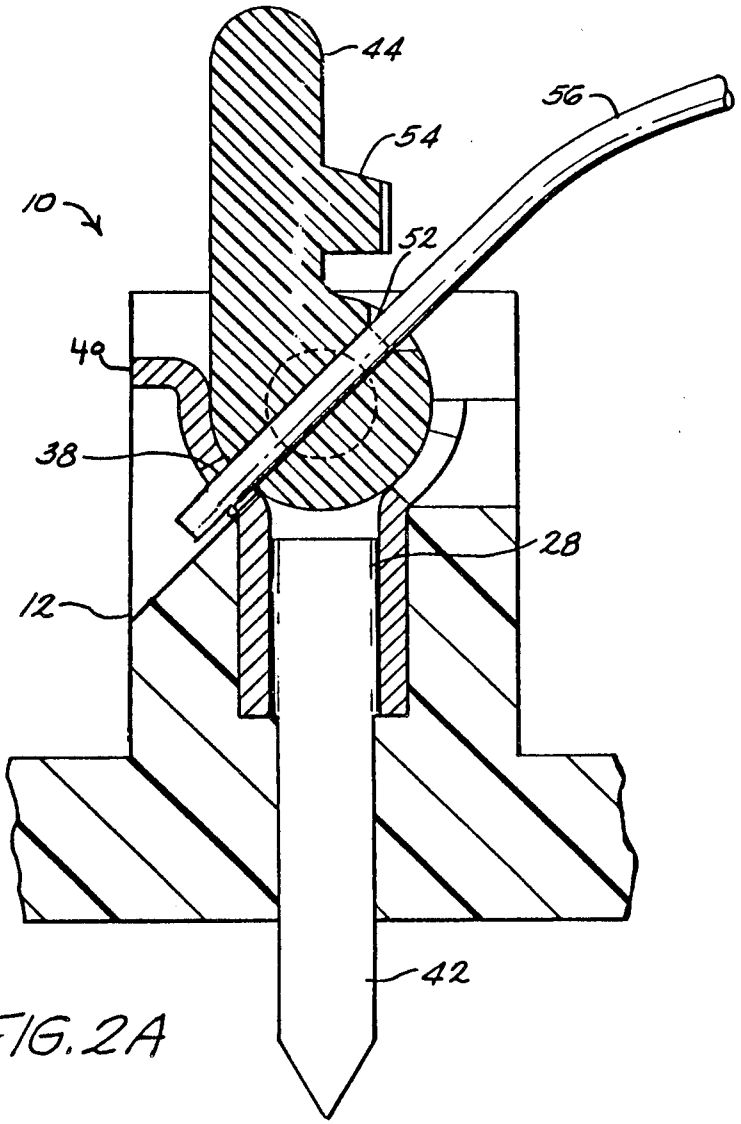
FIG. 2A is a side view partially in section of the electrical connector of FIG. 1 in a first position for receiving the electrical conductor.

The wire termination connector functions when the non-conductive cam lever 44 is in a first position, upright, such that wire passageway 52 is fully accessible for an electrical conductor 60 to be installed therethrough. As illustrated in FIG. 2A, installed electrical conductor 60 fits through the wire passageway of non-conductive cam lever 44 and through the feed-through 38 of electrically conductive terminal 28. Applying finger pressure and actuating the cam lever 44 to a second position, as illustrated in FIG. 2B, causes electrical conductor 60 to be severed on trimming edge 38, the excess wire dropping out gap 57 of the housing 12. Wire guide 54 guides the electrical conductor 60 downward into insulation displacement connection means 32 of first contact means 30 of the electrically conductive terminal 28. A detent 59, illustrated in FIG. 3, engages the non-conductive cam lever with the insulative base housing providing a tactile "snap-lock" response and retaining the cam lever 44 in this second position. Reverse motion of cam lever 44 results in disengagement of electrical conductor 60 from the insulation displacement connection means 32 permitting withdrawal of the electrical conductor 60 from the connector 10.

Figure 2C:
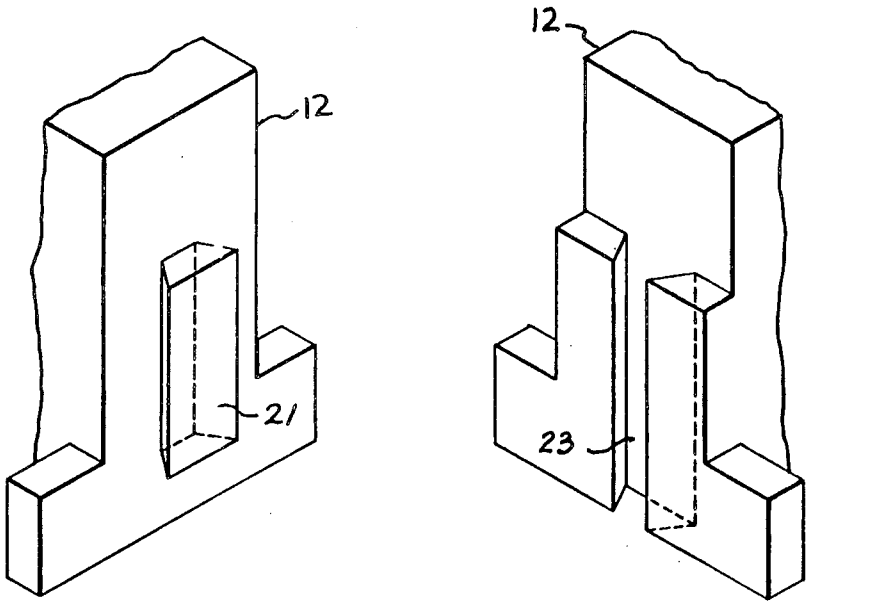
FIG. 2C is a perspective partial view of a base housing having a dovetail tenon and mortise for ganging.
Figure 2D:
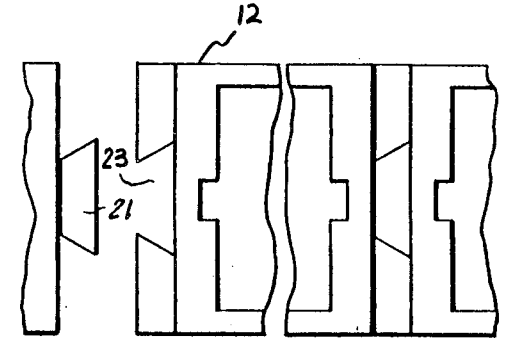
FIG. 2D is a top view of a plurality of base housings ganged via dovetail mortise and tenon.
Figure 3:
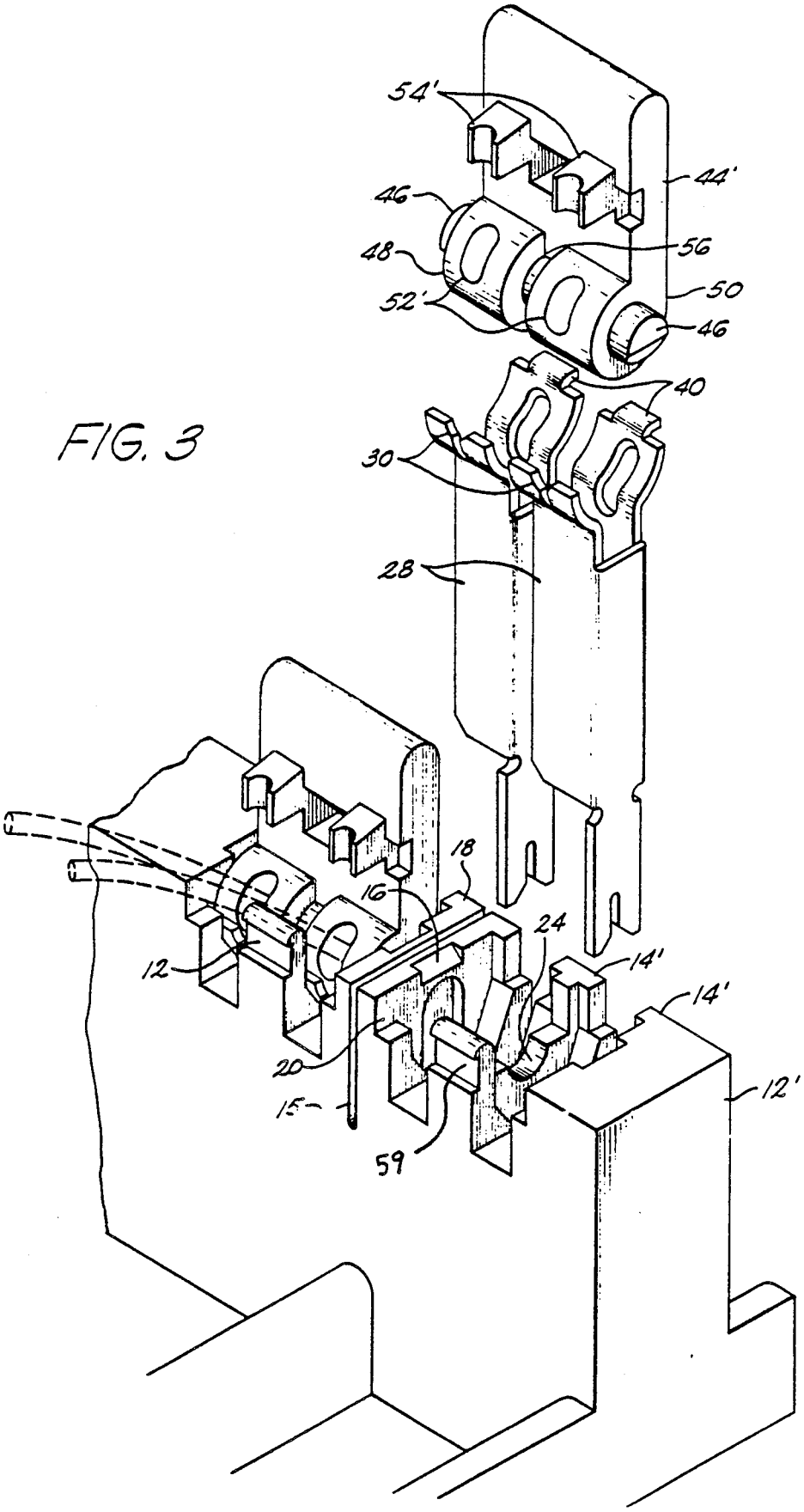
FIG. 3 is an exploded perspective view of an electrical connector for terminating a plurality of electrical conductors according to the invention.
Figure 4:
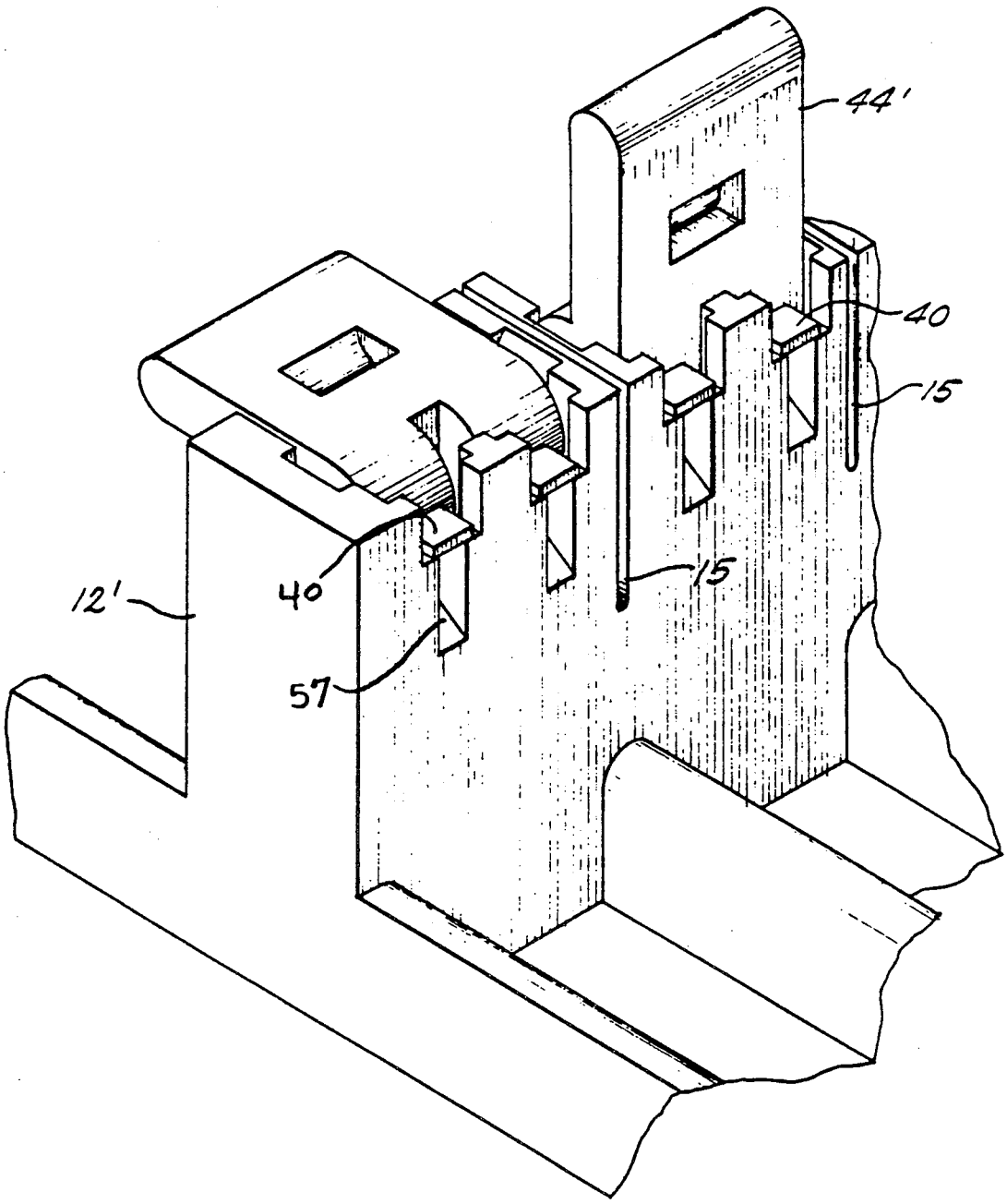
FIG. 4 is a perspective view of the electrical connector of FIG. 3.
Figure 5:
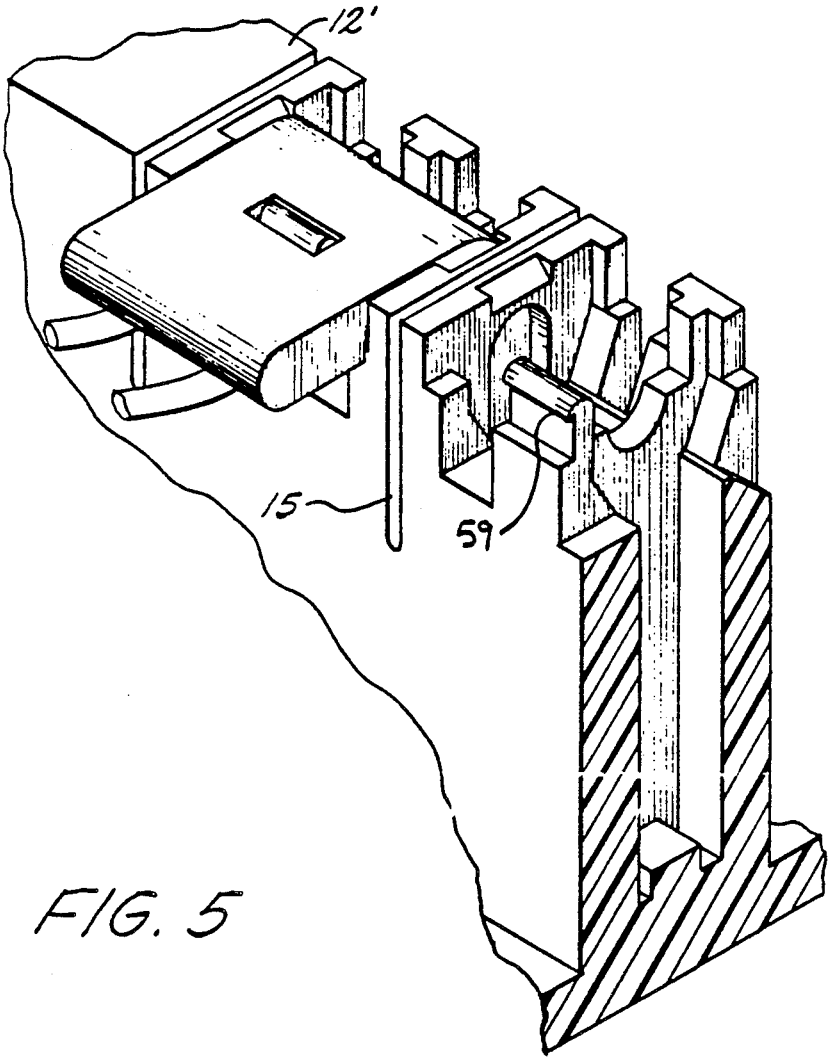
FIG. 5 is a perspective view partially in section of the electrical connector of FIG. 3.

An alternative embodiment, as illustrated in FIGS. 3–5, is similar in construction and function to the single wire electrical connector embodiment of FIGS. 1, 2A and 2B. A multiple wire connector 10', according to the invention, has an insulative base housing 12' which has a plurality of walls 14' also opposed in pairs and interposed with stress relieving slots 15. Similarly, an angular notch 16 provides a ramp from an upper end surface 18 to an inner surface 20. A groove 22 on the inner surface 20 is also substantially the same width as angular notch 16. Arcuate surfaced support section 24', however, although recessed and intermediately bounded by the plurality of walls, forms a plurality of terminal receiving cavities between support section 24' and the walls 14'.

A plurality of electrically conductive terminals 28 each has features identical to the conductive terminal of FIGS. 1, 2A, and 2B.

Although similar in construction and identical in function, a non-conductive cam lever 44', which has the same lateral hub 46 protruding at first end 48 and protruding at second end 50, has a plurality of wire passageways 52' and wire guides 54'. Intermediate to the passageways 52 on the cam lever 44', a recess 56 separates the plurality of passageways 52' and facilitates alignment of the cam lever 44' with the arcuate surfaced support section 24' of the base housing 12'.

When the plurality of conductive terminals 28 are slidably installed in the base housing 12', arcuate surfaced support section 24' fits into the recess 56 of the cam lever 44' to maintain the alignment of each conductive terminal 28 with its respective wire passageway 52'. Functionally, assembly and actuation of the cam lever from a first position wherein an electrical conductor can be installed, to a second position wherein excess wire trimming and insulation displacement connection takes place, is identical to that of the embodiment discussed with reference to FIGS. 1, 2A and 2B.

Figure 7:
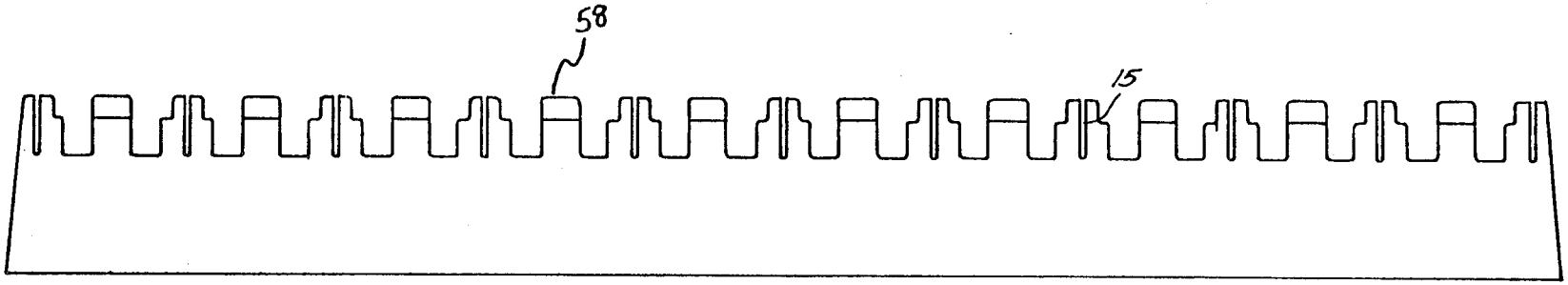
FIG. 7 is a side view in section of the terminal block of FIG. 6.
Figure 6:
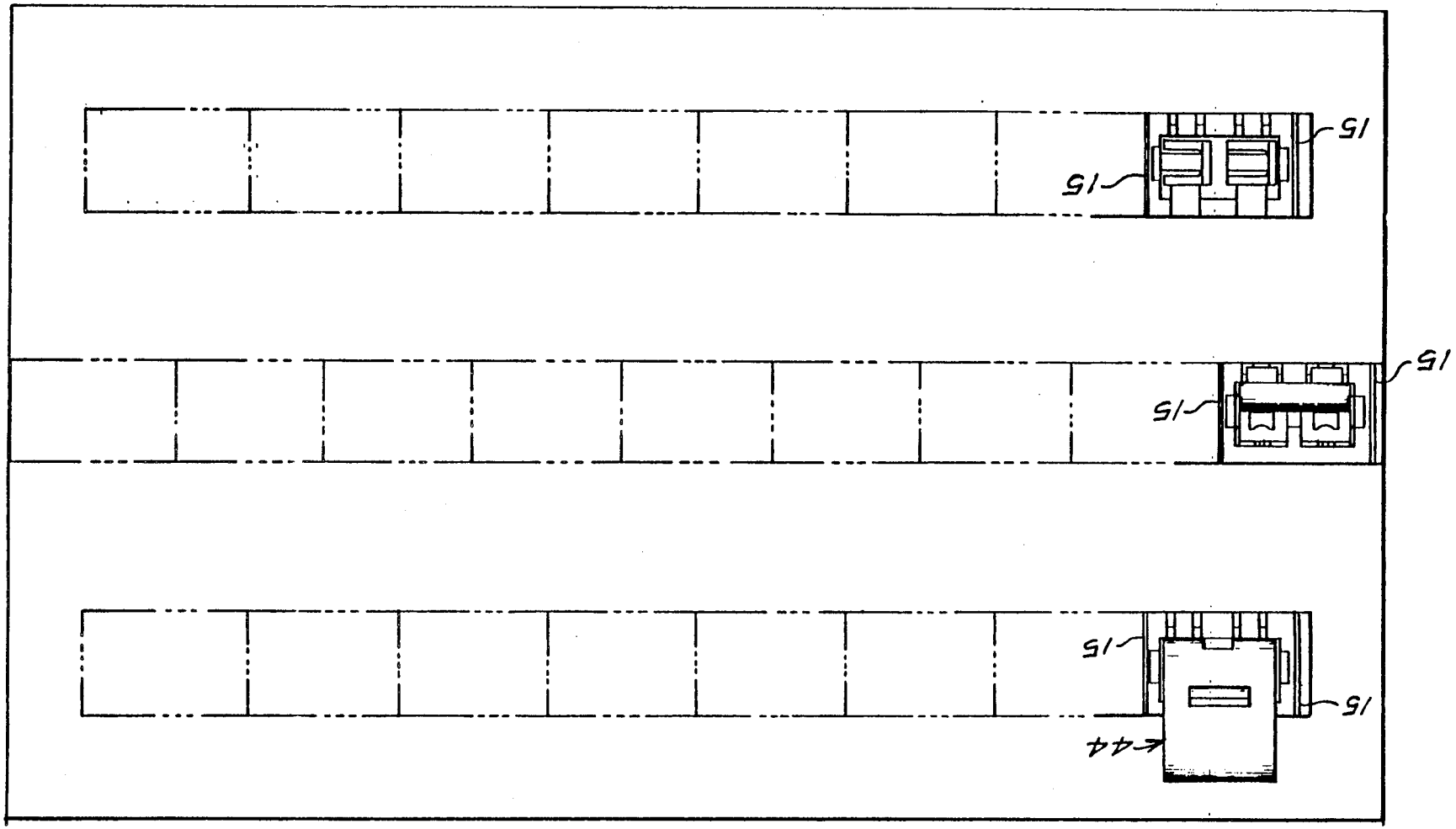
FIG. 6 is a top view of a terminal block comprising electrical connectors for terminating a plurality of electrical conductors according to the invention.

Alternatively, referring now to FIGS. 6 and 7, the electrical connector embodiments disclosed hereinbefore, may be configured in a matrix of rows and columns. A core 58 of insulative material is molded to provide a series of base housings into which a plurality of conductive electrical terminals 28 may be installed. The core 58 may be molded to accept either single wire cam lever 44 or multiple wire cam lever 44'. While space requirements may dictate that core 58 be configured in rows, and columns, a plurality of connectors according to the invention may be configured as either interlocking/ganged rows having dovetail mortise 21 and tenon 23 or as individual rows installed in a flanged mounting base or otherwise mechanically mountable. Functionality and assembly of a matrix of connectors or a terminal block is identical to the functionality and assembly of the respective embodiments discussed hereinbefore.

While the electrical connectors disclosed herein are discussed as single, multiple or matrix embodiments, great flexibility in ultimate configuration is achievable using these inventive concepts. Whether implemented singly or in combination, each housing may be molded to accommodate a plurality or a single electrically conductive terminal 28 such that a quantitative variety of terminals may be configured in a terminal block.

Although the invention has been shown and described with respect to illustrative embodiments thereof, it should be understood by those skilled in the art that the foregoing and various other changes, omissions, and additions in the form and detail thereof may be made therein without departing from the spirit and scope of the invention.

What is claimed is:

1. An electrical connector for terminating an electrical conductor having a metallic core covered with insulation, comprising:

an insulative base housing comprising a plurality of walls opposed in pairs, each of a pair of said walls having an angular notch providing a ramp from an upper end surface to an inner surface and a groove on said inner surface substantially the same width as said angular notch, a support section recessed and intermediately bounded by said plurality of walls forming a terminal receiving cavity, an electrically conductive terminal comprising a first contact means for insulation displacement connection of said electrical conductor and a second contact means for feed-through and trimming of said electrical conductor, said first and second contact means joining with a lower-extending member and fitting slidably into said insulative base housing terminal receiving cavity, and a non-conductive cam lever comprising a lateral hub protruding from a first end and a second end of said cam lever, a wire passageway extending through said cam lever substantially perpendicular to said lateral hub, said lateral hub of said first end and said second end of said cam lever mating with said groove on said inner surface of each of a pair of said walls and said wire passageway aligning with said first and second contact means, said cam lever being rotatable from a first position wherein said electrical conductor is installable through said wire passageway and said second contact means to a second position wherein said electrical conductor is trimmed by said second contact means and is connected to said first contact means.

2. The electrical connector of claim 1 wherein said insulative base housing further comprises detent means for engaging said non-conductive cam lever and for providing a tactile response when said non conductive cam lever is engaged by said insulative housing and for retaining said non-conductive cam lever in said engaged position.

3. The electrical connector of claim 1 wherein said insulative base housing has stress relieving means, interposed in said plurality of walls, for facilitating ease of mating said lateral hub protruding from said first end and said second end of said non-conductive cam lever with said groove on said inner surface of each of a pair of said walls.

4. The electrical connector of claim 1 wherein said lower extending member of said electrically conductive terminal is an insulation displacement contact.

5. The electrical connector of claim 1 wherein said lower extending member of said electrically conductive terminal is pin-like means for coupling to a feed-through in a printed circuit board.

6. The electrical connector of claim 1 wherein said electrically conductive terminal has a test point portion protruding from said second contact and said insulative base housing has a gap allowing said test point portion to be accessed therefrom.

7. The electrical connector of claim 1 wherein said non-conductive cam lever has a wire-guide aligned with said wire-passageway and said wire passageway and said wire guide are specifically sized to reject oversized wires.

8. An electrical connector for terminating a plurality of electrical conductors each having a metallic core covered with insulation, comprising:

an insulative base housing comprising a plurality of walls opposed in pairs, each of a pair of said walls having an angular notch providing a ramp from an upper end surface to an inner surface and a groove on said inner surface substantially the same width as said angular notch, a support section recessed and intermediately bounded by said plurality of walls forming a plurality of terminal receiving cavities between said support section and said walls, a plurality of electrically conductive terminals each comprising a first contact means for insulation displacement connection of one of said plurality of electrical conductors and a second contact means for feed-through and trimming of same electrical conductor, said first and second contact means joining with a lower-extending member and fitting slidably into said terminal receiving cavity, and a non-conductive cam lever comprising a lateral hub protruding from a first end and a second end of said cam lever, a plurality of wire passageways extending through said cam lever substantially perpendicular to said lateral hub, said lateral hub of said first end and said second end of said cam lever mating with said groove on said inner surface of each of a pair of said walls and said plurality of wire passageways aligning with said first and second contacts of said plurality of conductive terminals, and said cam lever being rotatable, from a first position wherein said plurality of electrical conductors is each installable through one of said plurality of wire passageways and respectively said second contact means, to a second position wherein each of said electrical conductors is trimmed by said second contact means and is connected to said first contact means.

9. The electrical connector of claim 8 wherein said insulative base housing further comprises detent means for engaging said non-conductive cam lever and for providing a tactile response when said non-conductive cam lever is engaged by said insulative housing and for retaining said non-conductive cam lever in said engaged position.

10. The electrical connector of claim 8 wherein said insulative base housing has stress relieving means, interposed in to said plurality of walls, for facilitating ease of mating said lateral hub protruding from said first end and said second end of said non-conductive cam lever with said groove on said inner surface of each of a pair of said walls.

11. The electrical connector of claim 8 wherein said lower extending member of said electrically conductive terminal is an insulation displacement contact.

12. The electrical connector of claim 8 wherein said lower extending member of said electrically conductive terminal is pin-like means for coupling to a feed-through in a printed circuit board.

13. The electrical connector of claim 8 wherein said electrically conductive terminal has a test point portion protruding from said second contact and said insulative base housing has a gap allowing said test point portion to be accessed therefrom.

14. The electrical connector of claim 8 wherein said non-conductive cam lever has at least one wire-guide aligned with each of said plurality of wire-passageways.

15. The electrical connector of claim 14 wherein said wire-passageways and said wire guides are specifically sized to reject oversized wires.

16. A terminal block comprising:

a plurality of electrical connectors for terminating a plurality of conductors each having a metallic core covered with insulation, each of said electrical connectors comprising, an insulative base housing comprising a plurality of walls opposed in pairs, each of a pair of said walls having an angular notch providing a ramp from an upper end surface to an inner surface and a groove on said inner surface substantially the same width as said angular notch, a support section recessed and intermediately bounded by said plurality of walls forming at least one terminal receiving cavity between said support section and said walls, a plurality of electrically conductive terminals each comprising a first contact means for insulation displacement connection of one of said plurality of electrical conductors and a second contact means for feed-through and trimming of same electrical conductor, said first and second contact means joining with a lower-extending member and fitting slidably into said terminal receiving cavity, and a non-conductive cam lever comprising a lateral hub protruding from a first end and a second end of said cam lever, at least one wire passageway extending through said cam lever substantially perpendicular to said lateral hub, said lateral hub of said first end and said second end of said cam lever mating with said groove on said inner surface of each of a pair of said walls and each of said at least one plurality of wire passageway aligning with said first and second contacts of each of said plurality of conductive terminals, and said cam lever being rotatable, from a first position wherein said plurality of electrical conductors is each installable through one of said at least one wire passageway and respectively said second contact means, to a second position wherein each of said electrical conductors is trimmed by said second contact means and is connected to said first contact means.

17. The terminal block of claim 16 wherein said insulative base housing further comprises detent means for engaging said non-conductive cam lever and for providing a tactile response when said non-conductive cam lever is engaged by said insulative housing and for retaining said non-conductive cam lever in said engaged position.

18. The terminal block of claim 16 wherein said insulative base housing has stress relieving means, interposed in said plurality of walls, for facilitating ease of mating said lateral hub protruding from said first end and said second end of said non-conductive cam lever with said groove on said inner surface of each of a pair of said walls.

19. The terminal block of claim 16 wherein said lower extending member of said electrically conductive terminal is an insulation displacement contact.

20. The electrical connector of claim 16 wherein said lower extending member of said electrically conductive terminal is pin-like means for coupling to a feed-through in a printed circuit board.

21. The terminal block of claim 16 wherein said electrically conductive terminal has a test point portion protruding from said second contact and said insulative base housing has a gap allowing said test point portion to be accessed therefrom.

22. The terminal block of claim 16 wherein said non-conductive cam lever has a wire-guide aligned with said wire-passageway.

23. The terminal block of claim 22 wherein said wire passageway and said wire guide are specifically sized to reject oversized wires.

24. An electrical connector for terminating at least one electrical conductor having a metallic core covered with insulation, comprising:

an insulative base housing comprising a plurality of walls, a support section recessed and intermediately bounded by said plurality of walls forming a terminal receiving cavity;

at least one electrically conductive terminal comprising a first contact means for insulation displacement connection of said electrical conductor and a second contact means for feed-through and trimming of said electrical conductor, said electrically conductive terminal fitting slidably into said terminal receiving cavity; and at least one non-conductive cam lever comprising a lateral hub protruding from a first end and a second end of said cam lever, a wire passageway extending through said cam lever, said wire passageway aligning with said first and second contact means.

25. The electrical connector of claim 24 wherein said insulative base housing further comprises detent means for engaging said non-conductive cam lever and for providing a tactile response when said non-conductive cam lever is engaged by said insulative housing and for retaining said non-conductive cam lever in said engaged position.

26. The electrical connector of claim 24 wherein said insulative base housing has stress relieving means, interposed in said plurality of walls, for facilitating ease of mating with said lateral hub protruding from said first end and said second end of said non-conductive cam lever.

27. The electrical connector of claim 24 wherein said electrically conductive terminal has a lower extending member which is an insulation displacement contact.

28. The electrical connector of claim 24 wherein said electrically conductive terminal has a lower extending member which is pin-like means for coupling to a feed-through in a printed circuit board.

29. The electrical connector of claim 24 wherein said electrically conductive terminal has a test point portion protruding from said second contact and said insulative base housing has a gap allowing said test point portion to be accessed therefrom.

30. The electrical connector of claim 24 wherein said non-conductive cam lever has a wire-guide aligned with said wire-passageway and said wire-passageway and said wire-guide are specifically sized to reject oversized wires.

31. The electrical connector of claim 24 wherein said insulative base housing has a plurality of support sections forming a plurality of terminal receiving cavities.

* * * * *